US011427794B2

(12) United States Patent
Piorkowski

(10) Patent No.: US 11,427,794 B2
(45) Date of Patent: Aug. 30, 2022

(54) LOW DENSITY UNIT DOSE DETERGENTS BASED ON BUTYL CELLOSOLVE WITH ENCAPSULATED FRAGRANCE

(71) Applicant: Henkel AG & Co. KGaA, Duesseldorf (DE)

(72) Inventor: Daniel Thomas Piorkowski, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 32 days.

(21) Appl. No.: 16/720,325

(22) Filed: Dec. 19, 2019

(65) Prior Publication Data

US 2021/0189302 A1 Jun. 24, 2021

(51) Int. Cl.

| | |
|---|---|
| ***C11D 1/83*** | (2006.01) |
| ***C11D 17/04*** | (2006.01) |
| ***C11D 1/14*** | (2006.01) |
| ***C11D 3/50*** | (2006.01) |
| ***C11D 3/20*** | (2006.01) |
| ***C11D 1/74*** | (2006.01) |

(52) U.S. Cl.

CPC ..... *C11D 17/043* (2013.01); *C11D 1/146* (2013.01); *C11D 1/74* (2013.01); *C11D 3/2065* (2013.01); *C11D 3/2068* (2013.01); *C11D 3/505* (2013.01)

(58) Field of Classification Search

CPC .... C11D 1/22; C11D 1/29; C11D 1/72; C11D 1/83; C11D 3/0268; C11D 11/0017; C11D 17/042; C11D 3/505

See application file for complete search history.

(56) References Cited

U.S. PATENT DOCUMENTS

| | | | | |
|---|---|---|---|---|
| 3,929,678 | A | 12/1975 | Laughlin et al. | |
| 3,976,586 | A | 8/1976 | Chakrabarti | |
| 5,616,781 | A | 4/1997 | Sajic et al. | |
| 5,945,394 | A | 8/1999 | Sajic et al. | |
| 5,958,864 | A | 9/1999 | Artiga Gonzalez et al. | |
| 6,024,943 | A | 2/2000 | Ness et al. | |
| 6,046,149 | A | 4/2000 | Sorrie et al. | |
| 6,056,949 | A | 5/2000 | Menzi et al. | |
| 6,136,776 | A * | 10/2000 | Dickler | C11D 1/72 510/296 |
| 6,194,375 | B1 | 2/2001 | Ness et al. | |
| 6,458,754 | B1 | 10/2002 | Velazquez et al. | |
| 8,426,353 | B2 | 4/2013 | Ouali et al. | |
| 8,865,638 | B2 | 10/2014 | Adamy | |
| 9,434,916 | B2 * | 9/2016 | Catlin | C11D 1/722 |
| 2009/0312221 | A1 * | 12/2009 | Lant | C11D 3/38681 510/320 |
| 2011/0224127 | A1 | 9/2011 | Blyth et al. | |
| 2015/0030643 | A1 * | 1/2015 | Gartstein | D06M 13/10 424/401 |
| 2015/0159358 | A1 * | 6/2015 | Burt | E03D 9/005 4/231 |
| 2015/0307816 | A1 * | 10/2015 | Panandiker | D06M 23/02 510/276 |
| 2016/0137956 | A1 * | 5/2016 | Hayward | C11D 3/42 510/325 |
| 2017/0173591 | A1 | 6/2017 | She et al. | |
| 2017/0292097 | A1 | 10/2017 | Fang et al. | |
| 2017/0369818 | A1 | 12/2017 | Park et al. | |
| 2018/0049957 | A1 | 2/2018 | Droge et al. | |
| 2018/0334641 | A1 * | 11/2018 | Piorkowski | C11D 1/65 |
| 2019/0017001 | A1 | 1/2019 | Camire et al. | |
| 2020/0071639 | A1 * | 3/2020 | Smets | C11D 3/38672 |
| 2020/0199344 | A1 * | 6/2020 | Labeque | C08J 5/18 |

FOREIGN PATENT DOCUMENTS

| | | | |
|---|---|---|---|
| EP | 1589092 | A1 | 10/2005 |
| WO | 2017201404 | A1 | 11/2017 |

OTHER PUBLICATIONS

International Searching Authority, PCT International Search Report, PCT/US2020/066496, dated Apr. 13, 2021, pp. 1-9, Daejeon, South Korea.

* cited by examiner

*Primary Examiner* — Charles I Boyer
(74) *Attorney, Agent, or Firm* — Bojuan Deng

(57) ABSTRACT

The present disclosure is in the fields of household and industrial cleaning, particularly in applications for cleaning laundry. In one aspect the present disclosure provides liquid unit dose detergent product, having: (a) a container formed from a water-soluble or water-dispensible film material; and (b) a liquid composition having: (i) at least one surfactant; (ii) at least one encapsulated fragrance; and (iii) a solvent system that includes at least one low density organic solvent having a density less than 1.0 g/mL and at least one high density organic solvent having a density greater than 1.0 g/mL; wherein the water-soluble or water-dispensible film material forms a container that entraps the liquid composition.

10 Claims, 1 Drawing Sheet

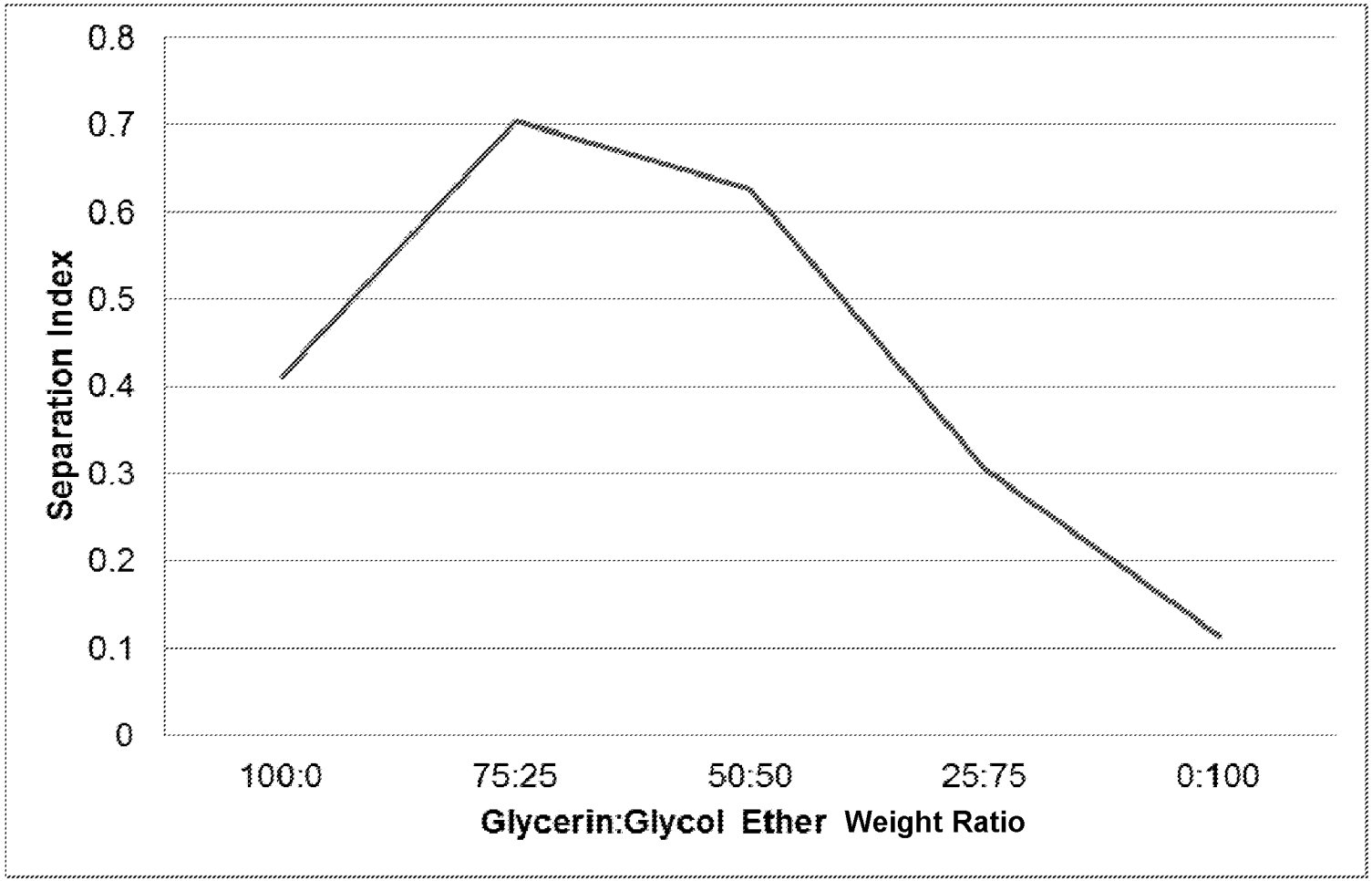
Separation Index
0.8
0.7
0.6
0.5
0.4
0.3
0.2
0.1
0
100:0
75:25
50:50
25:75
0:100
Glycerin:Glycol Ether Weight Ratio

LOW DENSITY UNIT DOSE DETERGENTS BASED ON BUTYL CELLOSOLVE WITH ENCAPSULATED FRAGRANCE

FIELD OF THE INVENTION

The present disclosure is in the fields of household and industrial cleaning, particularly in applications for cleaning laundry. The present disclosure provides liquid compositions useful for unit dose detergents comprising (a) at least one surfactant; (b) at least one encapsulated fragrance; (c) and a solvent system that comprises at least one high density organic solvent and at least one low density organic solvent.

BACKGROUND OF THE INVENTION

Many home care and personal care formulations seek to deliver benefit agents to substrates such as textiles, hard surfaces, hair, and skin. Encapsulated benefit agents are known in the art and many are commercially available. Encapsulation of fragrances has generated particular interest and activity.

Encapsulated fragrance particles allow for controlled fragrance release throughout the wash cycle, better retention of fragrance on washed articles, and extended release of retained fragrance post-drying. However, encapsulated fragrance particles often have a density which is less than the density of the liquid composition causing the encapsulated fragrance to become unstable over time due to gravitational separation. Thus, there remains a need for compositions that provide a stable suspension for encapsulated fragrance particles without these and other known drawbacks.

Accordingly, a need exists to inhibit gravitational separation of an encapsulated fragrance in a liquid composition.

BRIEF SUMMARY OF THE INVENTION

The present disclosure provides a unit dose detergent product, comprising:

(a) a container formed from a water-soluble or water-dispensible film material; and (b) a liquid composition comprising:

(i) at least one surfactant;

(ii) at least one encapsulated fragrance; and (iii) a solvent system that comprises at least one low density organic solvent having a density less than 1.0 g/mL and at least one high density organic solvent having a density greater than 1.0 g/mL;

wherein the water-soluble or water-dispensible film material forms a container that entraps the liquid composition.

The present disclosure also provides a liquid composition comprising:

(a) at least one surfactant;

(b) at least one encapsulated fragrance;

(c) a solvent system that comprises at least one low density organic solvent having a density less than 1.0 g/mL and at least one high density organic solvent having a density greater than 1.0 g/mL.

In some embodiments, the weight ratio of the high density organic solvent to the low density organic solvent in the liquid composition is from about 45:55 to about 1:99.

In some embodiments, the liquid composition has a viscosity from about 10 mPa·s to about 500 mPa·s measured at a shear rate of 20/s.

In some embodiments, the liquid composition can be stably stored at room temperature for between 1 month and 30 months.

In some embodiments, the surfactant in the liquid composition is selected from the group consisting of an anionic surfactant, a nonionic surfactant, a zwitterionic surfactant, a cationic surfactant, and an amphoteric surfactant.

In some embodiments, the anionic surfactant in the liquid composition is an alkyl ether sulfate or a linear alkyl benzene sulfonate.

In some embodiments, the nonionic surfactant in the liquid composition is an alcohol ethoxylate.

In some embodiments, the liquid composition comprises an anionic surfactant and a nonionic surfactant.

In some embodiments, the anionic surfactant in the liquid composition is an alkyl ether sulfate and a linear alkyl benzene sulfonate and the nonionic surfactant is a $C_{12}$-$C_{15}$ alcohol ethoxylate.

In some embodiments, the low density organic solvent in the liquid composition is a glycol ether.

In some embodiments, the low density organic solvent in the liquid composition is selected from the group consisting of diethylene glycol monobutyl ether, triethylene glycol monobutyl ether, ethylene glycol monobutyl ether, diethylene glycol diethyl ether, diethylene glycol monobutyl ether, ethylene glycol monobutyl ether, diethylene glycol dimethyl ether, tetraethylene glycol dimethyl ether, diethylene glycol monoethyl ether, diethylene glycol monomethyl ether, ethylene glycol dimethyl ether, triethylene glycol dimethyl ether, ethylene glycol monoethyl ether, ethylene glycol diethyl ether, diethyl glycol diethyl ether, ethylene glycol monomethyl ether, propylene glycol methyl ether, propylene glycol n-butyl ether, propylene glycol n-propyl ether, dipropylene glycol methyl ether, dipropylene glycol n-butyl ether, tripropylene glycol monomethyl ether, tripropylene glycol n-butyl ether, dipropylene glycol dimethyl ether, and poly (ethylene glycol) monomethyl ethers.

In some embodiments, the low density organic solvent in the liquid composition is ethylene glycol monobutyl ether.

In some embodiments, the high density organic solvent in the liquid composition is selected from the group consisting of 1,2-propanediol, ethylene glycol, diethylene glycol, polyethylene glycol, glycerine, ethoxylated glycerine, and propoxylated glycerine.

In some embodiments, the high density organic solvent in the liquid composition is glycerine.

In some embodiments, the weight ratio of the high density organic solvent to the low density organic solvent in the liquid composition is from about 25:75 to about 10:90.

The present disclosure also provides a unit dose laundry detergent product comprising:

(a) a container formed from a water-soluble or water-dispensible film material; and (b) a liquid composition comprising:

(i) at least one surfactant;

(ii) at least one encapsulated fragrance; and (iii) a solvent system that comprises at least one low density organic solvent with a density less than 1.0 g/mL;

wherein the water-soluble or water-dispensible film material forms a container that entraps the liquid composition.

BRIEF DESCRIPTION OF THE DRAWINGS

The accompanying drawing, which is incorporated herein and form a part of the specification, illustrates the present invention and, together with the description, further serves to explain the principles of the invention and to enable a person skilled in the pertinent art to make and use the invention.

The FIGURE is a line graph showing the separation index values measured for five liquid compositions with the following ratios of glycerine to glycol ether: a glycerine:glycol ether weight ratio of 0:100, a glycerine:glycol ether weight ratio of 100:0, a glycerine:glycol ether weight ratio of 75:25, a glycerine:glycol ether weight ratio of 50:50, a glycerine:glycol ether weight ratio of 25:75, and a glycerine:glycol ether weight ratio of 0:100.

DETAILED DESCRIPTION OF THE INVENTION

All of the various aspects, embodiments, and options disclosed herein can be combined in any and all variants unless otherwise specified. Unless defined otherwise, all technical and scientific terms used herein have the same meaning as commonly understood by one of ordinary skill in the art to which this disclosure is related. The headings provided herein are not limitations of the various applications or aspects of the disclosure, which can be had by reference to the specification as a whole. Accordingly, the terms defined immediately below are more fully defined by reference to the specification in its entirety.

The following description provides specific details, such as materials and amounts, to provide a thorough understanding of the present invention. The skilled artisan, however, will appreciate that the present invention can be practiced without employing these specific details. Indeed, the present invention can be practiced in conjunction with processing, manufacturing, or fabricating techniques conventionally used in the detergent industry.

As used herein, "a," "an," and "the" include the plural referents unless the context clearly dictates otherwise. The terms "a" or "an," as well as the terms "one or more," and "at least one" can be used interchangeably herein.

As used herein, the term "comprising" means including, made up of, and composed of.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

As used herein, the term "stable" refers to a mixture or composition that resists change or decomposition due to internal reaction or due to the action of air, heat, light, pressure, or other natural conditions. In some embodiments, the stability of a liquid composition can be determined by measuring the amount of sedimentation and/or creaming.

As used herein, the term "sedimentation" or "creaming" refers to upward ("creaming") as well as downward ("sedimentation") separation of solid particles from a liquid suspension. "Non-sedimenting" means non-sedimentary under normal conditions of storage unless otherwise stated. Typically, "non-sedimenting" or "non-creaming" implies no significant sedimentation is observed after one week at room temperature under normal earth gravity. The term does not exclude compositions which show a degree of syneresis, whereby a part of the high density phase separates to form a clear layer external to a homogeneous gel or dispersion. Such partly separated systems can usually be dispersed by shaking. This is in contrast to sedimented or creamed systems wherein a solid sediment separates from the dispersion, which generally presents substantially greater problems in dispersing and dispensing the product. The amount of sedimentation and/or creaming of a liquid composition can be determined by measuring the light transmission value at a wavelength between 109.4 nm to 130.1 nm using an analytical centrifuge. The light transmission value is used to calculate a separation index value between 0 and 1.0, with 1.0 being 100% separated. A liquid composition is stable if the separation index value is less than 0.6 after 2.5 hours.

As used herein, the term "liquid" refers to a fluid having a viscosity of from about 1 to about 2000 mPa·s at 25° C. and a shear rate of 20/s. In some embodiments, the viscosity of the liquid at 25° C. and a shear rate of 20/s is from about 1 mPa·s to about 2000 mPa·s, about 1 mPa·s to about 1000 mPa·s, about 1 mPa·s to about 500 mPa·s, about 1 mPa·s to about 200 mPa·s, about 200 mPa·s to about 2000 mPa·s, about 200 mPa·s to about 1000 mPa·s, about 200 mPa·s to about 500 mPa·s, about 500 mPa·s to about 2000 mPa·s, about 500 mPa·s to about 1000 mPa·s, or about 100 mPa·s to about 2000 mPa·s.

The "weight percentage" or "wt %" as used herein refers to the weight percentage of an ingredient as compared to the total weight of the liquid composition. For example, the weight percentage of sodium lauryl ether sulfate (SLES) refers to the weight percentage of the active SLES in the composition. The weight percentage of the total water in the liquid composition is calculated based on all the water including those added as a part of individual ingredients. When an ingredient added to make the liquid composition is not 100% pure and used as a mixture, e.g., in a form of a solution, the weight percentage of that ingredient added refers to the weight percentage of the mixture.

As used herein, the term "substantially free from" refers to the presence of no more than 0.5% of an indicated material in a composition by total weight of the composition. In some embodiments, a composition that is substantially free of an indicated material has no more than 0.5%, 0.2%, or 0.1% of the indicated material by total weight of the composition.

As used herein, the term "external structurant" is a material that has a primary function of providing rheological alteration, typically by increasing viscosity of a fluid, such as a liquid or gel or paste. External structurants do not, in and of themselves, provide any significant cleaning or care benefit. In some embodiments, the external structurant is a cellulose, a polysaccharide, or hydrogenated castor oil. In some embodiments, the liquid composition is substantially free from an external structurant. In some embodiments, the liquid composition is substantially free from hydrogenated castor oil.

Encapsulated fragrance provides a long-term fragrance benefit to the consumer, enabling freshness of washed clothes for more than 1 month (compared to un-encapsulated fragrances such as free oil which may provide freshness up to a week). Encapsulated fragrances often have a density which is less than the traditional density of unit dose detergents (normally around 1.05 g/mL or higher), causing encapsulated fragrances to become unstable over time due to gravitational separation. To prevent this separation from occurring, it is known to structure the detergents with a structuring agent such as hydrogenated castor oil to lock the encapsulated fragrances into suspension; thus eliminating separation.

The present disclosure employs selective solvent systems that enable a lower density detergent, eliminating the need for a structuring agent by matching the density of the detergent solution to the density of the encapsulated fragrance. It also reduces or eliminates the need to put weighting oils in the fragrance to increase the density of the encapsulated fragrance to match the liquid detergent density.

Liquid Composition

In some embodiments, the present disclosure provides a liquid composition comprising:

(a) at least one surfactant;

(b) at least one encapsulated fragrance;

(c) a solvent system that has a density that matches the density of the encapsulated fragrance.

In some embodiments, the present disclosure provides a liquid composition comprising:

(a) at least one surfactant;

(b) at least one encapsulated fragrance; and (c) a solvent system comprising at least one low density organic solvent having a density less than 1.0 g/mL and at least one high density organic solvent having a density greater than 1.0 g/mL.

In some embodiments, the present disclosure provides a liquid composition comprising:

(a) at least one surfactant;

(b) at least one encapsulated fragrance;

(c) a solvent system. comprising at least one low density organic solvent having a density less than 1.0 g/mL and at least one high density organic solvent having a density greater than 1.0 g/mL; wherein the weight ratio of the high density organic solvent to the low density organic solvent is from about 40:60 to about 1:99.

Another embodiment is directed to the liquid compositions above, that can be stably stored at room temperature for between 1 day and 3 years, between 18 months and 30 months, or between 7 days and 1 month.

Surfactants

In some embodiments, the liquid composition comprises at least one surfactant. In some embodiments, the liquid composition comprises 1 to 8, 1 to 7, 1 to 6, 1 to 5, 1 to 4, 1 to 3, 1 to 2, 2 to 8, 2 to 7, 2 to 6, 2 to 5, 2 to 4, 2 to 3, 3 to 8, 3 to 7, 3 to 6, 3 to 5, 3 to 4, 4 to 8, 4 to 7, 4 to 6, 4 to 5, 5 to 8, 5 to 7, 5 to 6, 6 to 8, 6 to 7, or 7 to 8 surfactants. In some embodiments, the liquid composition comprises 1, 2, 3, 4, 5, 6, 7, or 8 surfactants. In some embodiments, the liquid composition comprises 3 surfactants.

Useful surfactants in the liquid compositions of the present invention are surfactants that are useful for cleaning laundry, dishware and/or household items. Useful surfactants include, for example, an anionic surfactant, a nonionic surfactant, a zwitterionic surfactant, a cationic surfactant, an amphoteric surfactant, and combinations thereof.

In some embodiments, the liquid composition comprises at least one anionic surfactant, at least one nonionic surfactant, and combinations thereof. In some embodiments, the liquid composition comprises at least one anionic surfactant and at least one nonionic surfactant. In some embodiments, the liquid composition comprises two anionic surfactants and one nonionic surfactant.

Anionic Surfactants

In some embodiments, the liquid composition comprises at least one anionic surfactant. In some embodiments, the liquid composition comprises 1 to 5, 1 to 4, 1 to 3, 1 to 2, 2 to 5, 2 to 4, 2 to 3, 3 to 5, 3 to 4, or 4 to 5 anionic surfactants. In some embodiments, the liquid composition comprises 1, 2, 3, 4, or 5 anionic surfactants. In some embodiments, the liquid composition comprises 2 anionic surfactants.

Suitable anionic surfactants include but are not limited to those surfactants that contain in their molecular structure a long chain hydrocarbon hydrophobic group and a hydrophilic group, i.e., water solubilizing group including salts such as carboxylate, sulfonate, sulfate, or phosphate groups. Suitable anionic surfactant salts include sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group.

In some embodiments, the anionic surfactant is a polyethoxylated alcohol sulfate, such as those sold under the trade name CALFOAM 303 (Pilot Chemical Company, West Chester, Ohio). Such materials, also known as alkyl ether sulfates (AES) or alkyl polyethoxylate sulfates, are those which correspond to formula (I):

$$R^1—O—(C_2H_4O)_n—SO_3M^1 \quad (I)$$

wherein $R^1$ is a $C_8$-$C_{20}$ alkyl group, n is from 1 to 20, and $M^1$ is a salt-forming cation.

In some embodiments, $R^1$ is a $C_{10}$-$C_{18}$ alkyl, n is from 1 to 15, and $M^1$ is sodium, potassium, ammonium, alkylammonium, or alkanolammonium. In some embodiments, $R^1$ is a $C_{12}$-$C_{16}$ alkyl, n is from 1 to 6, and $M^1$ is sodium.

In some embodiments, the at least one anionic surfactant is an alkyl ether sulfate. In some embodiments, the alkyl ether sulfate is sodium lauryl ether sulfate (SLES).

The alkyl ether sulfates will generally be used in the form of mixtures comprising varying $R^1$ chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the liquid compositions of this invention. Suitable unalkoxylated, e.g., unethoxylated, alkyl ether sulfate surfactants are those produced by the sulfation of higher $C_8$-$C_{20}$ fatty alcohols. Conventional primary alkyl sulfate surfactants have the general formula of: $R^2OSO_3M^2$, wherein $R^2$ is a linear $C_8$-$C_{20}$ hydrocarbyl group, which may be straight chain or branched chain, and $M^2$ is a water-solubilizing cation. In some embodiments, $R^2$ is a $C_{10}$-$C_{15}$ alkyl, and $M^2$ is an alkali metal. In some embodiments, $R^2$ is a $C_{12}$-$C_{14}$ alkyl and $M^2$ is sodium. Examples of other anionic surfactants are disclosed in U.S. Pat. No. 3,976,586, the disclosure of which is incorporated by reference herein.

In some embodiments, the anionic surfactant is a water soluble salt of an alkyl benzene sulfonate having between 8 and 22 carbon atoms in the alkyl group. In some embodiment, the anionic surfactant comprises an alkali metal salt of $C_{10}$-$C_{16}$ alkyl benzene sulfonic acids, such as $C_{11}$-$C_{14}$ alkyl benzene sulfonic acids. In some embodiments, the alkyl group is linear and such linear alkyl benzene sulfonates are abbreviated as "LAS." Other suitable anionic surfactants include sodium and potassium linear, straight chain alkylbenzene sulfonates in which the average number of carbon atoms in the alkyl group is between 11 and 14. In some embodiments, the anionic surfactant is sodium $C_1$-$C_{14}$, e.g., $C_{12}$, LAS.

In some embodiments, the anionic surfactant is a α-sulfofatty acid ester. Such a sulfofatty acid is typically formed by esterifying a carboxylic acid with an alkanol and then sulfonating the α-position of the resulting ester. Such materials, known as α-sulfofatty acid ester are those which correspond to formula (II):

$$\begin{array}{l} R^3CHCOOR^4 \\ \quad\;\; | \\ \quad\;\; SO_3R^5 \end{array} \quad (II)$$

wherein $R^3$ is a linear or branched alkyl, $R^4$ is a linear or branched alkyl, and $R^5$ is hydrogen, a halogen, a mono-valent or di-valent cation, or an unsubstituted or substituted ammonium cation. In some embodiments, $R^3$ is a $C_4$-$C_{24}$ alkyl, including a $C_{10}$, $C_{12}$, $C_{14}$, $C_{16}$, and/or $C_{18}$ alkyl. In some embodiments, $R^4$ is a $C_1$-$C_8$ alkyl, including a methyl group. In some embodiments, $R^5$ is a mono-valent or di-valent cation, such as a cation that forms a water soluble salt with the α-sulfofatty acid ester (e.g., an alkali metal salt such as sodium, potassium or lithium). In some embodiments, the α-sulfofatty acid ester of formula (II) is a methyl ester sulfonate, such as a $C_{16}$ methyl ester sulfonate, a $C_{18}$ methyl ester sulfonate, or a combination thereof. In some embodiments, the α-sulfofatty acid ester of formula (II) is a methyl ester sulfonate, such as a mixture of $C_{12}$-$C_{18}$ methyl ester sulfonates.

In some embodiments, where the $R^5$ of formula (II) is a monovalent metal, the α-sulfofatty acid ester is of formula (III):

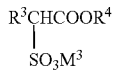

(III)

wherein $R^3$ and $R^4$ are linear or branched alkyls and $M^3$ is a monovalent metal. In some embodiments, $R^3$ is a $C_4$-$C_{24}$ alkyl, including a $C_{10}$, $C_{12}$, $C_{14}$, $C_{16}$, and/or $C_{18}$ alkyl. In some embodiments, $R^4$ is a $C_1$-$C_8$ alkyl, including a methyl group. In some embodiments, $M^3$ is an alkali metal, such as sodium or potassium. In some embodiments, the α-sulfofatty acid ester of formula (III) is a sodium methyl ester sulfonate, such as a sodium $C_8$-$C_{18}$ methyl ester sulfonate.

In some embodiments, the liquid composition comprises by weight about 5% to about 50% of at least one anionic surfactant. In some embodiments, the liquid composition comprises by weight about 5% to about 50%, about 5% to about 40%, about 5% to about 30%, about 5% to about 25%, about 5% to about 20%, about 5% to about 10%, about 10% to about 50%, about 10% to about 40%, about 10% to about 30%, about 10% to about 25%, about 10% to about 20%, about 20% to about 50%, about 20% to about 40%, about 20% to about 30%, about 20% to about 25%, about 25% to about 50%, about 25% to about 40%, about 25% to about 30%, about 30% to about 50%, about 30% to about 40%, or about 40% to about 50% of at least one anionic surfactant. In some embodiments, the liquid composition by weight about 25% to about 35% of at least one anionic surfactant.

Nonionic Surfactants

Suitable nonionic surfactants include but are not limited to alkoxylated fatty alcohols, ethylene oxide (EO)-propylene oxide (PO) block polymers, and amine oxide surfactants. Suitable for use in the liquid compositions herein are those nonionic surfactants which are normally liquid. Suitable nonionic surfactants for use herein include alcohol alkoxylate nonionic surfactants. Alcohol alkoxylates are materials which correspond to the general formula of: $R^6(C_mH_{2m}O)_pOH$, wherein $R^6$ is a linear or branched $C_8$-$C_{16}$ alkyl group, m is from 2 to 4, and p is from 2 to 12.

In some embodiments, $R^6$ is a linear or branched $C_9$-$C_{15}$ or $C_{10}$-$C_{14}$ alkyl group. In some embodiments, the alkoxylated fatty alcohols are ethoxylated materials that contain from 2 to 12, or 3 to 10, EO moieties per molecule. The alkoxylated fatty alcohol materials useful in the liquid compositions herein will frequently have a hydrophilic-lipophilic balance (HLB) which ranges from 3 to 17, from 6 to 15, or from 8 to 15. Alkoxylated fatty alcohol nonionic surfactants have been marketed under the tradenames NEODOL and Dobanol (Shell Chemical Company, Houston, Tex.). Another nonionic surfactant suitable for use includes ethylene oxide (EO)-propylene oxide (PO) block polymers, such as those marketed under the tradename PLURONIC (BASF Corporation, Mount Olive, N.J.). These materials are formed by adding blocks of ethylene oxide moieties to the ends of polypropylene glycol chains to adjust the surface active properties of the resulting block polymers.

In some embodiments, the nonionic surfactant is a $C_{12}$-$C_{15}$ alcohol ethoxylate. In some embodiments, the nonionic surfactant is $C_{12}$-$C_{15}$ alcohol ethoxylate 7EO. In some embodiments, the nonionic surfactant is $C_{12}$-$C_{15}$ alcohol ethoxylate 7EO marketed under the tradename MASODOL 25-7 (Pilot Chemical Corporation, West Chester, Ohio).

Another example of a nonionic surfactant is alkoxylated, preferably ethoxylated or ethoxylated and propoxylated, fatty acid alkyl esters, having from 1 to 4 carbon atoms in the alkyl chain, especially fatty acid methyl esters. In some embodiments, the nonionic surfactant is methyl ester ethoxylate.

Suitable nonionic surfactants also include polyalkoxylated alkanolamides, which are generally of the following formula (IV):

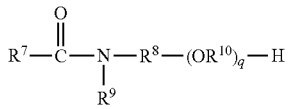

(IV)

wherein $R^7$ is an alkyl or alkoxy, $R^8$ and $R^{10}$ are alkyls, $R^9$ is hydrogen, an alkyl, an alkoxy group, or a polyalkoxylated alkyl, and r is a positive integer.

In some embodiments, $R^7$ is an alkyl containing 6 to 22 carbon atoms. In some embodiments, $R^8$ is an alkyl containing 1-8 carbon atoms. In some embodiments, $R^{10}$ is an alkyl containing 1 to 4 carbon atoms. In some embodiments, $R^{10}$ is an ethyl group. The degree of polyalkoxylation (the molar ratio of the oxyalkyl groups per mole of alkanolamide) typically ranges from about 1 to about 100, or from about 3 to about 8, or from about 5 to about 6. In some embodiments, the polyalkoxylated alkanolamide is a polyalkoxylated mono- or di-alkanolamide, such as a $C_{16}$ and/or $C_{18}$ ethoxylated monoalkanolamide, or an ethoxylated monoalkanolamide prepared from palm kernel oil or coconut oil.

Other suitable nonionic surfactants include those containing an organic hydrophobic group and a hydrophilic group that is a reaction product of a solubilizing group (such as a carboxylate, hydroxyl, amido, or amino group) with an alkylating agent, such as ethylene oxide, propylene oxide, or a polyhydration product thereof (such as polyethylene glycol). Such nonionic surfactants include, for example, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides. Other suitable surfactants include those disclosed in U.S. Pat. Nos. 5,945,394 and 6,046,149, the disclosures of which are incorporated herein by reference. In some embodiments, the composition is substantially free of nonylphenol nonionic surfactants. As used herein, the term "substantially free" means less than about one weight percent.

In some embodiments, the nonionic surfactant is an amine oxide surfactant. Amine oxides are often referred to in the art as "semi-polar" nonionics, and have the following formula (V):

$$R^{11}(EO)_x(PO)_y(BO)_zN(O)(CH_2R^{12})_2.rH_2O \quad (V)$$

wherein $R^{11}$ is a relatively long-chain hydrocarbyl moiety which can be saturated or unsaturated, linear or branched, and can typically contain from 8 to 20, from 10 to 16 carbon atoms, or a $C_{12}$-$C_{16}$ primary alkyl. $R^{12}$ is a short-chain moiety such as a hydrogen, methyl and —$CH_2OH$. When x+y+z is different from 0, EO is ethyleneoxy, PO is propyleneoxy, and BO is butyleneoxy. r is the number of water molecules in the surfactant. In one embodiment, the nonionic surfactant is $C_2$-$C_{14}$ alkyldimethyl amine oxide.

In some embodiments, the liquid composition comprises by weight about 5% to about 50% of at least one nonionic surfactant. In some embodiments, the liquid composition comprises by weight about 5% to about 50%, about 5% to about 40%, about 5% to about 30%, about 5% to about 25%, about 5% to about 20%, about 5% to about 10%, about 10% to about 50%, about 10% to about 40%, about 10% to about 30%, about 10% to about 25%, about 10% to about 20%, about 20% to about 50%, about 20% to about 40%, about 20% to about 30%, about 20% to about 25%, about 25% to about 50%, about 25% to about 40%, about 25% to about 30%, about 30% to about 50%, about 30% to about 40%, or about 40% to about 50% of at least one nonionic surfactants. In some embodiments, the liquid composition by weight about 25% to about 30% of at least one nonionic surfactant.

Zwitterionic Surfactants

In some embodiments, the liquid composition comprises at least one zwitterionic surfactant. In some embodiments, the liquid composition comprises 1 to 5, 1 to 4, 1 to 3, 1 to 2, 2 to 5, 2 to 4, 2 to 3, 3 to 5, 3 to 4, or 4 to 5 zwitterionic surfactants. In some embodiments, the liquid composition comprises 1, 2, 3, 4, or 5 zwitterionic surfactants. In some embodiments, the liquid composition does not comprise a zwitterionic surfactant.

Suitable zwitterionic surfactants include but not limited to derivatives of secondary and tertiary amines, derivatives of heterocyclic secondary and tertiary amines, or derivatives of quaternary ammonium, quaternary phosphonium or tertiary sulfonium compounds, such as those disclosed in U.S. Pat. No. 3,929,678, which is incorporated by reference herein in its entirety.

In some embodiments, the liquid composition comprises by weight about 1% to about 20% of at least one zwitterionic surfactant. In some embodiments, the liquid composition comprises by weight about 1% to about 20%, about 1% to about 15%, about 1% to about 10%, about 1% to about 5%, about 5% to about 20%, about 5% to about 15%, about 5% to about 10%, about 10% to about 20%, about 10% to about 15%, or about 15% to about 20% of at least one zwitterionic surfactant.

Cationic Surfactants

In some embodiments, the liquid composition comprises at least one cationic surfactant. In some embodiments, the liquid composition comprises 1 to 5, 1 to 4, 1 to 3, 1 to 2, 2 to 5, 2 to 4, 2 to 3, 3 to 5, 3 to 4, or 4 to 5 cationic surfactants. In some embodiments, the liquid composition comprises 1, 2, 3, 4, or 5 cationic surfactants. In some embodiments, the liquid composition does not comprise a cationic surfactant.

Suitable cationic surfactants include but are not limited to quaternary ammonium surfactants. Suitable quaternary ammonium surfactants include mono $C_6$-$C_{16}$, or $C_6$-$C_{10}$ N-alkyl or alkenyl ammonium surfactants, wherein the remaining N positions are substituted by, e.g., methyl, hydroxyethyl or hydroxypropyl groups. Another cationic surfactant is $C_6$-$C_{18}$ alkyl or alkenyl ester of a quaternary ammonium alcohol, such as quaternary chlorine esters. In another embodiment, the cationic surfactants have the following formula (VI):

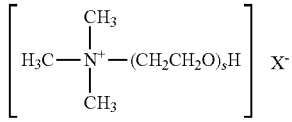

(VI)

wherein $R^{13}$ is $C_8$-$C_{18}$ hydrocarbyl and mixtures thereof, X is an anion such as chloride or bromide, and s is a positive integer. In some embodiments, $R^{13}$ is a $C_8$-$C_{14}$ alkyl. In some embodiments, $R^{13}$ is a $C_8$ alkyl, a $C_{10}$ alkyl, or a $C_{12}$ alkyl.

In some embodiments, the liquid composition comprises by weight about 1% to about 20% of at least one cationic surfactant. In some embodiments, the liquid composition comprises by weight about 1% to about 20%, about 1% to about 15%, about 1% to about 10%, about 1% to about 5%, about 5% to about 20%, about 5% to about 15%, about 5% to about 10%, about 10% to about 20%, about 10% to about 15%, or about 15% to about 20% of at least one cationic surfactant.

Amphoteric Surfactant

In some embodiments, the liquid composition comprises at least one anionic surfactant. In some embodiments, the liquid composition comprises 1 to 5, 1 to 4, 1 to 3, 1 to 2, 2 to 5, 2 to 4, 2 to 3, 3 to 5, 3 to 4, or 4 to 5 anionic surfactants. In some embodiments, the liquid composition comprises 1, 2, 3, 4, or 5 amphoteric surfactants. In some embodiments, the liquid composition does not comprise an amphoteric surfactant.

Other suitable surfactants include amphoteric surfactants. Suitable amphoteric surfactants for uses herein include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group.

In some embodiments, the liquid composition comprises by weight about 1% to about 20% of at least one amphoteric surfactant. In some embodiments, the liquid composition comprises by weight about 1% to about 20%, about 1% to about 15%, about 1% to about 10%, about 1% to about 5%, about 5% to about 20%, about 5% to about 15%, about 5% to about 10%, about 10% to about 20%, about 10% to about 15%, or about 15% to about 20% of at least one amphoteric surfactant.

Encapsulated Fragrance

As used herein, the term "perfume" or "fragrance" refers to a mixture of fragrant material extracts that collectively give a harmonious, pleasant, and characteristic fragrance. Each individual component of a fragrance has different chemical and physical properties, making them difficult to stabilize in the complex media of a liquid detergent due to the interaction of the different chemical groups present in their molecules. Fragrances are discussed, for example, in U.S. Pat. No. 6,056,949, which is incorporated by reference in its entirety.

In some embodiments, the only fragrance in the liquid composition is an encapsulated fragrance. In some embodiments, the liquid composition comprises at least one encapsulated fragrance and at least one free fragrance.

In some embodiments, the liquid composition comprises at least one encapsulated fragrance. In some embodiments, the liquid composition comprises from 1 to 5, 1 to 4, 1 to 3, 1 to 2, 2 to 5, 2 to 4, 2 to 3, 3 to 5, 3 to 4, or 4 to 5 encapsulated fragrances. In some embodiments, the liquid composition comprises 1, 2, 3, 4, or 5 encapsulated fragrances. In some embodiments, the liquid composition comprises 1 encapsulated fragrance.

In some embodiments, the fragrance is encapsulated in, for example, a water-insoluble shell, a microcapsule, a nanocapsule, or any combination thereof. Examples of encapsulated fragrance are known in the art in, for example, U.S. Pat. Nos. 6,024,943, 6,056,949, 6,194,375, 6,458,754, and 8,426,353, and in U.S. Patent Application Publication No. 2011/0224127, each of which is incorporated herein by reference in their entireties.

In some embodiments, the at least one encapsulated fragrance is encapsulated in a microcapsule. Microencapsulation is a technique by which one material (normally active) is coated with another material or system. The major purposes for using microencapsulation is to isolate incompatible substances present in the same formulation and to control the release of the active ingredient encapsulation. This release can be due to the diffusion of the active through the wall material (sustained release overtime), or it can be due to the breakage of the wall capsule (fast release).

In some embodiments, the at least one encapsulated fragrance has a musky scent, a putrid scent, a pungent scent, a camphoraceous scent, an ethereal scent, a floral scent, a peppermint scent, or a combination thereof.

In some embodiments, the at least one encapsulated fragrance comprises an ester, an ether, an aldehyde, a ketone, an alcohol, a hydrocarbon, or any combination thereof. In some embodiments, the at least one encapsulated fragrance comprises methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or a combination thereof.

In some embodiments, the encapsulated fragrance is an encapsulated fragrance marketed under the trade name POPSCENT (Firmenich SA, Geneva, Switzerland). In some embodiments, the encapsulated fragrance is POPSCENT 259366. In some embodiments, the encapsulated fragrance is POPSCENT 259366 in a 50:50 weight ratio premix of glycerine:encapsulated fragrance.

In some embodiments, the liquid composition comprises by weight about 1% to about 20% of at least one encapsulated fragrance. In some embodiments, the liquid composition comprises by weight about 1% to about 20%, about 1% to about 15%, about 1% to about 10%, about 1% to about 5%, about 5% to about 20%, about 5% to about 15%, about 5% to about 10%, about 10% to about 20%, about 10% to about 15%, or about 15% to about 20% of at least one encapsulated fragrance.

In some embodiments, creaming (rising to the surface) or sedimentation (settling to the bottom) of the encapsulated fragrance occurs over time, especially during storage of the product. The creaming or sedimentation is due to differences in density between the microcapsule and the surrounding liquid. Many consumer products including liquid household cleaners, liquid laundry products, personal care products, and cosmetic products have densities around 1 g/mL, while many organic compounds have densities much lower than 1 g/mL. So a microcapsule containing a high proportion of fragrance oils or other hydrophobic oils may have a lower density than the liquid phase of the product in which the microcapsules are dispersed, hence these microcapsules will tend to cream (rise to the surface) over time. If the microcapsule wall material is thin, or is made from lower density starting materials this creaming phenomenon will be more noticeable.

It may not be desirable or even possible to prepare microcapsules of different (usually smaller) size to reduce creaming as this may have other consequences, such as affecting the ease of breaking the walls for those microcapsules which rely on friability for content release. Moreover, less material is encapsulated into a smaller microcapsule requiring a higher proportion of wall material relative to content and a larger number of microcapsules to contain the same volume of core material which consequently may affect product attributes such as color and also the manufacturing cost. It may also be undesirable to increase the viscosity of the liquid product in which the microcapsules are dispersed, hence it is advantageous if the densities of the microcapsules and liquid phase can be more equally balanced.

So while it is advantageous if the densities of microcapsules can be closely balanced to the density of the liquid product into which they are to be dispersed, this is increasingly difficult to achieve for liquid products as the density increases beyond 0.900 g/mL, especially if the microcapsule walls are constructed from low density materials. Furthermore from the diverse constraints on the microcapsule wall such as: ease of manufacture, robustness to handling, stability in the product and release of microcapsule content at the appropriate time in use; and constraints on the core material: that the fragrance must be of sufficient quality and intensity to be acceptable in a premium commercial product, that it should be stable during microcapsule manufacture and not leak on storage, it is surprising that an additional density constraint can be imposed on the perfumer and yet they are able to provide consumer desirable fragrances.

In some embodiments, a low density organic solvent and a high density organic solvent are added to lower the density of the liquid composition.

Organic Solvent

In some embodiments, the liquid composition comprises at least one organic solvent. An organic solvent provides the following benefits to a liquid composition: (1) an organic solvent may allow for the formulation of a liquid composition comprising a high weight percentage of anionic surfactant; (2) an organic solvent may be used to adjust the viscosity of a liquid composition; (3) an organic solvent may allow for the formulation of an isotropic and physically stable liquid composition; (4) an organic solvent may allow enzymes, polymers, bleaches, chelants, and other ingredients to be added into the liquid compositions. An organic solvent may also be used to formulate stable, shippable concentrates comprising a high weight percentage of anionic surfactants, which may be combined downstream with other detergent ingredients to form a final detergent product.

In some embodiments, the liquid composition comprises at least one low density organic solvent. In some embodiments, the liquid composition comprises at least one high density organic solvent. In some embodiments, the liquid composition comprises at least one low density organic solvent and at least one high density organic solvent.

Low Density Organic Solvent

As used herein, the phrase "low density organic solvent" is an organic solvent that has a density less than 1.0 g/mL, preferably equal to or less than 0.9 g/mL.

In some embodiments, the low density organic solvent has a density of 0.8 g/mL to 0.99 g/mL. In some embodiments, the density of the low density organic solvent is from 0.8 g/mL to about 0.99 g/mL, 0.8 g/mL to 0.95 g/mL, 0.8 g/mL to 0.9 g/mL, 0.8 g/mL to 0.85 g/mL, 0.85 g/mL to about 0.99 g/mL, 0.85 g/mL to 0.95 g/mL, 0.85 g/mL to 0.9 g/mL, 0.9 g/mL to 0.99 g/mL, 0.9 g/mL to 0.95 g/mL, or 0.95 g/mL to 0.99 g/mL. In some embodiments, the low density organic solvent has a density of about 0.85 g/mL to about 0.95 g/mL.

In some embodiments, the liquid composition comprises at least one low density organic solvent. In some embodiments, the liquid composition comprises from 1 to 5, 1 to 4, 1 to 3, 1 to 2, 2 to 5, 2 to 4, 2 to 3, 3 to 5, 3 to 4, or 4 to 5 low density organic solvents. In some embodiments, the liquid composition comprises 1, 2, 3, 4, or 5 low density organic solvents. In some embodiments, the liquid composition comprises 1 low density organic solvent.

In some embodiments, the low density organic solvent is a glycol ether or a methyl ester.

In some embodiments, the low density organic solvent is a methyl ester. In some embodiments, the methyl ester has a molecular weight from about 74 g/mol to about 400 g/mol. Such materials are those of the general formula: $R^{14}$—C(O)—$OCH_3$ wherein $R^{14}$ is a $C_1$-$C_{18}$ alkyl. Examples of suitable methyl esters include methyl acetate, methyl propionate, methyl octanoate, and methyl dodecanoate.

In some embodiments, at least one low density organic solvent is a glycol ether.

Suitable glycol ethers alkylene glycol ethers, which are generally of the formula

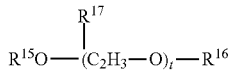

(VII)

wherein $R^{15}$ is hydrogen or $C_1$-$C_8$ alkyl; $R^{16}$ is $C_1$-$C_8$ alkyl; $R^{17}$ is hydrogen, methyl, or ethyl; and t is an integer of 1 to 16. In some embodiments, t is an integer of 1 to 5.

In some embodiments, the glycol ether is a water-miscible ethylene glycol ether.

In some embodiments, the glycol ether is diethylene glycol monobutyl ether, triethylene glycol monobutyl ether, ethylene glycol monobutyl ether, diethylene glycol diethyl ether, diethylene glycol monobutyl ether, ethylene glycol monobutyl ether, diethylene glycol dimethyl ether, tetraethylene glycol dimethyl ether, diethylene glycol monoethyl ether, diethylene glycol monomethyl ether, ethylene glycol dimethyl ether, triethylene glycol dimethyl ether, ethylene glycol monoethyl ether, ethylene glycol diethyl ether, diethyl glycol diethyl ether, ethylene glycol monomethyl ether, propylene glycol methyl ether, propylene glycol n-butyl ether, propylene glycol n-propyl ether, dipropylene glycol methyl ether, dipropylene glycol n-butyl ether, tripropylene glycol monomethyl ether, tripropylene glycol n-butyl ether, dipropylene glycol dimethyl ether, and poly(ethylene glycol) monomethyl ethers. In some embodiments, the poly (ethylene glycol) monomethyl ether has a molecular weight ($M_w$) of about 500 to about 5,000.

In some embodiments, the glycol ether is diethylene glycol monobutyl ether, triethylene glycol monobutyl ether, ethylene glycol monobutyl ether, diethylene glycol diethyl ether, diethylene glycol monobutyl ether, ethylene glycol monobutyl ether, diethylene glycol dimethyl ether, tetraethylene glycol dimethyl ether, diethylene glycol monoethyl ether, diethylene glycol monomethyl ether, ethylene glycol dimethyl ether, triethylene glycol dimethyl ether, ethylene glycol monoethyl ether, ethylene glycol diethyl ether, diethyl glycol diethyl ether, ethylene glycol monomethyl ether, propylene glycol methyl ether, propylene glycol n-butyl ether, propylene glycol n-propyl ether, dipropylene glycol methyl ether, dipropylene glycol n-butyl ether, tripropylene glycol monomethyl ether, tripropylene glycol n-butyl ether, or dipropylene glycol dimethyl ether.

In some embodiments, the glycol ether is a commercially available glycol ether. In some embodiments, the glycol ether is a commercially available glycol ether sold under the trade name DOWANOL PM (propylene glycol methyl ether), DOWANOL DPM (dipropylene glycol methyl ether), DOWANOL TPM (tripropylene glycol methyl ether), DOWANOL PnB (propylene glycol n-butyl ether), DOWANOL DPnB (dipropylene glycol n-butyl ether), DOWANOL TPnB (tripropylene glycol n-butyl ether), DOWANOL PnP (propylene glycol n-propyl ether), DOWANOL DPnP (dipropylene glycol n-propyl ether), PROGLYDE DMM (dipropylene glycol dimethyl ether), hexyl CARBITOL (diethylene glycol monohexyl ether), hexyl CELLOSOLVE (ethylene glycol monohexyl ether), or butyl CELLOSOLVE (ethylene glycol monobutyl ether) (Dow Chemical Company, Midland, Mich.). In some embodiments, the glycol ether is butyl CELLOSOLVE.

In some embodiments, the liquid composition comprises by weight about 2% to about 40% of the at least one low density organic solvent. In some embodiments, the liquid composition comprises by weight about 2% to about 40%, about 2% to about 30%, about 2% to about 25%, about 2% to about 20%, about 2% to about 15%, about 2% to about 10%, about 2% to about 5%, about 5% to about 40%, about 5% to about 30%, about 5% to about 25%, about 5% to about 20%, about 5% to about 15%, about 5% to about 10%, about 10% to about 40%, about 10% to about 30%, about 10% to about 25%, about 10% to about 20%, about 10% to about 15%, about 15% to about 40%, about 15% to about 30%, about 15% to about 25%, about 15% to about 20%, about 20% to about 40%, about 20% to about 30%, about 20% to about 25%, about 25% to about 40%, about 25% to about 30%, or about 30% to about 40% of the at least one low density organic solvent.

In some embodiments, glycol ether(s) are the only low density organic solvent in the liquid composition. In some embodiments, the composition comprises from about 10 wt % to about 30 wt % of ethylene glycol monobutyl ether. In some embodiments, the composition comprises from about 15 wt % to about 25 wt % of ethylene glycol monobutyl ether. In some embodiments, the composition comprises about 20 wt % of ethylene glycol monobutyl ether. In some embodiments, the ethylene glycol monobutyl ether is butyl CELLOSOLVE.

High Density Organic Solvent

As used herein, the phrase "high density organic solvent" is an organic solvent that has a density greater than 1.0 g/mL, preferably greater than 1.1 g/mL, and more preferably greater than 1.2 g/mL.

In some embodiments, the density of the high density organic solvent is from 1.01 g/mL to 1.5 g/mL, 1.01 g/mL to 1.4 g/mL, 1.04 g/mL to 1.3 g/mL, 1.01 g/mL to 1.2 g/mL, 1.01 g/mL to 1.1 g/mL, 1.1 g/mL to 1.5 g/mL, 1.1 g/mL to 1.4 g/mL, 1.1 g/mL to 1.3 g/mL, 1.1 g/mL to 1.2 g/mL, 1.2 g/mL to 1.5 g/mL, 1.2 g/mL to 1.4 g/mL, 1.2 g/mL to 1.3 g/mL, 1.3 g/mL to 1.5 g/mL, 1.3 g/mL to 1.4 g/mL, or 1.4 g/mL to 1.5 g/mL. In some embodiments, the high density organic solvent has a density of about 1.01 g/mL to about 1.3 g/mL.

In some embodiments, the liquid composition comprises from 1 to 5, 1 to 4, 1 to 3, 1 to 2, 2 to 5, 2 to 4, 2 to 3, 3 to 5, 3 to 4, or 4 to 5 high density organic solvents. In some embodiments, the liquid composition comprises 1, 2, 3, 4, or 5 high density organic solvents. In some embodiments, the liquid composition comprises 1 high density organic solvent. In some embodiments, the liquid composition comprises 2 high density organic solvents.

In some embodiments, the high density organic solvent is 1,2-propanediol, ethylene glycol, diethylene glycol, polyethylene glycol, glycerine, ethoxylated glycerine, or propoxylated glycerine. In some embodiments, the high density organic solvent is glycerine. In some embodiments, the high density organic solvent is propylene glycol.

In some embodiments, the high density organic solvent is polyethylene glycol with an average molecular weight ($M_n$) between about 200 and about 600.

In some embodiments, the liquid composition comprises by weight about 2% to about 40% of at least one high density organic solvent. In some embodiments, the liquid composition comprises by weight about 2% to about 40%, about 2% to about 30%, about 2% to about 25%, about 2% to about 20%, about 2% to about 15%, about 2% to about 10%, about 2% to about 5%, about 5% to about 40%, about 5% to about 30%, about 5% to about 25%, about 5% to about 20%, about 5% to about 15%, about 5% to about 10%, about 10% to about 40%, about 10% to about 30, about 10% to about 25%, about 10% to about 20%, about 10% to about 15%, about 15% to about 40%, about 15% to about 30%, about 15% to about 25%, about 15% to about 20%, about 20% to about 40%, about 20% to about 30%, about 20% to about 25%, about 25% to about 40%, about 25% to about 30%, or about 30% to about 40% of the at least one high density organic solvent. In some embodiments, the liquid composition comprises by weight about 15% to about 25% of the at least one high density organic solvent.

In some embodiments, the liquid composition comprises by weight about 2% to about 30% of glycerine. In some embodiments, the liquid composition comprises by weight about 5% to about 20% of glycerine. In some embodiments, the liquid composition does not comprise glycerine.

Ratio of High Density Organic Solvent to Low Density Organic Solvent

In some embodiments, the liquid composition comprises at least one high density organic solvent and at least one low density organic solvent. In some embodiments, the weight ratio of high density organic solvent to low density organic solvent is from about 40:60 to about 0:100. In some embodiments, the weight ratio of high density organic solvent to low density organic solvent is from about 40:60 to 1:99. In some embodiments, the weight ratio of high density organic solvent to low density organic solvent is from about 30:70 to about 0:100. In some embodiments, the weight ratio of high density organic solvent to low density organic solvent is from about 25:75 to about 10:90. In some embodiments, the weight ratio of high density organic solvent to low density organic solvent is about 40:60, about 30:70, about 25:75, about 20:80, about 10:90, about 5:95, about 1:99, or about 0:100. In some embodiments, the weight ratio of high density organic solvent to low density organic solvent is from about 45:55 to about 1:99. In some embodiments, the weight ratio of high density organic solvent to low density organic solvent is from about 30:70 to about 20:80. In some embodiments, the weight ratio of high density organic solvent to low density organic solvent is 25:75.

In some embodiments, the liquid composition comprises glycerine and a glycol ether. In some embodiments, the weight ratio of glycerine:glycol ether is from about 40:60 to about 0:100. In some embodiments, the weight ratio of glycerine:glycol ether is from about 40:60 to 1:99. In some embodiments, the weight ratio of glycerine:glycol ether is from about 30:70 to about 0:100. In some embodiments, the weight ratio of glycerine:glycol ether is from about 25:75 to about 10:90. In some embodiments, the weight ratio of glycerine:glycol ether is about 40:60, about 30:70, about 25:75, about 20:80, about 10:90, about 5:95, about 1:99, or about 0:100. In some embodiments, the weight ratio of glycerine:glycol ether is about 1:1 to about 1:99.

Humectants

A humectant, for purposes of the present invention, is a substance that exhibits high affinity for water, especially attracting water for moisturizing and solubilizing purposes. The water is absorbed into the humectant; not merely adsorbed at a surface layer. The water absorbed by the humectant is available to the system; it is not too tightly bound to the humectant. For example, in a skin lotion, the humectant attracts moisture from the surrounding atmosphere while reducing transepidermal water loss, and makes the water available to the skin barrier. Similarly, the humectant in a single dose liquid formula will not trap all the water needed for solubilization of other formula components—it will help to maintain the water balance between the formula, the pouch or package film, and the atmosphere. These humectants possess hydrophilic groups which form hydrogen bonds with water. Common hydrophilic groups include hydroxyl, carboxyl, ester, and amine functionalities. A humectant can thus act as a solubilizer and moisture regulator in a unit dose formulation. Useful humectants include but not limited to polyols.

The polyol (or polyhydric alcohol) may be a linear or branched alcohol with two or more hydroxyl groups. Thus diols with two hydroxyl groups attached to separate carbon atoms in an aliphatic chain may also be used. The polyol typically includes less than 9 carbon atoms, such as 9, 8, 7, 6, 5, 4, 3, or 2 carbon atoms. Preferably, the polyol includes 3 to 8 carbon atoms. More preferably, the polyol includes 3 to 6 carbon atoms. The molecular weight is typically less than 500 g/mol, such as less than 400 g/mol or less than 300 g/mol.

In some embodiments, the polyol is propylene glycol, butylene glycol, pentylene glycol, hexylene glycol, heptylene glycol, octylene glycol, 2-methyl-1,3-propanediol, xylitol, sorbitol, mannitol, diethylene glycol, triethylene glycol, glycerol, erythritol, dulcitol, inositol, or adonitol.

In some embodiments, the polyol is propylene glycol.

In some embodiments, the liquid composition comprises by weight about 5% to about 30% of at least one humectant. In some embodiments, the liquid composition comprises by weight about 5% to about 30%, about 5% to about 25%, about 5% to about 20%, about 5% to about 15%, about 5% to about 10%, about 10% to about 30%, about 10% to about 25%, about 10% to about 20%, about 10% to about 15%, about 15% to about 30%, about 15% to about 25%, about 15% to about 20%, about 20% to about 30%, about 20% to about 25%, or about 25% to about 30% of at least one humectant. In some embodiments, the liquid composition comprises by weight about 5% to about 10% of at least one humectant.

Enzymes

Suitable enzymes include those known in the art, such as amylolytic, proteolytic, cellulolytic or lipolytic type, and those listed in U.S. Pat. No. 5,958,864, the disclosure of which is incorporated herein by reference. One protease, sold under the trade name SAVINASE® by Novozymes A/S, is a subtillase from *Bacillus lentus*. Other suitable enzymes include proteases, amylases, lipases and cellulases, such as ALCALASE® (bacterial protease), EVERLASE® (protein-engineered variant of SAVINASE®), ESPERASE® (bacterial protease), LIPOLASE® (fungal lipase), LIPOLASE ULTRA (Protein-engineered variant of LIPOLASE), LIPOPRIME® (protein-engineered variant of LIPOLASE), TERMAMYL® (bacterial amylase), BAN (Bacterial Amylase Novo), CELLUZYME® (fungal enzyme), and CAREZYME® (monocomponent cellulase), sold by Novozymes A/S. Additional enzymes of these classes suitable for use in accordance with the present invention will be well-known to those of ordinary skill in the art, and are available from a variety of commercial suppliers including but not limited to Novozymes A/S and Genencor/Danisco.

Foam Controlling Agent

Suitable foam controlling agents include a polyalkoxylated alkanolamide, amide, amine oxide, betaine, sultaine, $C_8$-$C_{18}$ fatty alcohols, and those disclosed in U.S. Pat. No. 5,616,781, the disclosure of which is incorporated by reference herein. Foam controlling agents are used, for example, in amounts of about 1 to about 20, typically about 3 to about 5 percent by weight. The composition can further include an auxiliary foam controlling surfactant, such as a fatty acid amide surfactant. Suitable fatty acid amides are $C_8$-$C_{20}$ alkanol amides, monoethanolamides, diethanolamides, and isopropanolamides.

In some embodiments, the composition comprises coconut oil fatty acid as a foam controlling agent. In some embodiments, the liquid composition comprises coconut oil fatty acid. In some embodiments, the composition comprises by weight from about 1% to about 50%, about 1% to about 40%, about 1% to about 30%, about 1% to about 25%, about 1% to about 20%, about 1% to about 15%, about 1% to about 10%, about 5% to about 50%, about 5% to about 40%, about 5% to about 30%, about 5% to about 25%, about 5% to about 20%, about 5% to about 15%, about 5% to about 10%, about 10% to about 50%, about 10% to about 40%, about 10% to about 30%, about 10% to about 25%, about 10% to about 20%, about 10% to about 15%, about 15% to about 50%, about 15% to about 40%, about 15% to about 30%, about 15% to about 25%, about 15% to about 20%, about 20% to about 50%, about 20% to about 40%, about 20% to about 30%, about 20% to about 25%, about 25% to about 50%, about 25% to about 40%, about 25% to about 30%, about 30% to about 50%, about 30% to about 40%, or about 40% to about 50% of coconut oil fatty acid. In some embodiments, the liquid composition comprises by weight from about 0% to about 15% coconut oil fatty acid.

Ethanolamine

Ethanolamines are used in liquid laundry detergents because they impart a reserve alkalinity to the laundry bath, which is essential for efficient cleaning. They also neutralize fatty acids present in the oily soap components and convert them into amine soaps—aiding in the overall cleaning process. In some embodiments, the ethanolamine is a monoethanolamine, a diethanolamine, a triethanolamine, or combinations thereof. In some embodiments, the ethanolamine is a monoethanolamine.

In some embodiments, the liquid composition comprises an ethanolamine. In some embodiments, the solid composition comprises an ethanolamine. In some embodiments, the composition comprises by weight from about 0.5% to about 30%, about 0.5% to about 20%, about 0.5% to about 10%, about 0.5% to about 8%, about 0.5% to about 6%, about 0.5% to about 4%, about 0.5% to about 2%, about 0.5% to about 1%, about 1% to about 30%, about 1% to about 20%, about 1% to about 10%, about 1% to about 8%, about 1% to about 6%, about 1% to about 4%, about 1% to about 2%, about 2% to about 30%, about 2% to about 20%, about 2% to about 10%, about 2% to about 8%, about 2% to about 6%, about 2% to about 4%, about 4% to about 30%, about 4% to about 20%, about 4% to about 10%, about 4% to about 8%, about 4% to about 6%, about 6% to about 30%, about 6% to about 20%, about 6% to about 10%, about 6% to about 8%, about 8% to about 30%, about 8% to about 20%, about 8% to about 10%, about 10% to about 30%, about 10% to about 20%, or about 20% to about 30% of an ethanolamine. In some embodiments, the composition comprises by weight from about 0.5% to about 10% of monoethanolamine. In some embodiments, the liquid composition comprises by weight from about 3% to about 6% of monoethanolamine.

Colorants

In some embodiments, the liquid composition does not contain a colorant.

In some embodiments, the liquid composition contains one or more colorants. The colorant(s) can be, for example, polymers. The colorant(s) can be, for example, dyes. The colorant(s) can be, for example, water-soluble polymeric colorants.

The colorant(s) can be, for example, water-soluble dyes. The colorant(s) can be, for example, colorants that are well-known in the art or commercially available from dye or chemical manufacturers.

The color of the colorant(s) is not limited, and can be, for example, red, orange, yellow, blue, indigo, violet, or any combination thereof. The colorant(s) can be, for example, one or more Milliken LIQUITINT colorants. The colorant(s) can be, for example Milliken LIQUITINT: VIOLET LS, ROYAL MC, BLUE HP, BLUE MC, AQUAMARINE, GREEN HMC, BRIGHT YELLOW, YELLOW LP, YELLOW BL, BRILLIANT ORANGE, CRIMSON, RED MX, PINK AL, RED BL, RED ST, or any combination thereof.

The colorant(s) can be, for example, one or more of Acid Blue 80, Acid Red 52, and Acid Violet 48.

Acid Blue 80 has the chemical structure:

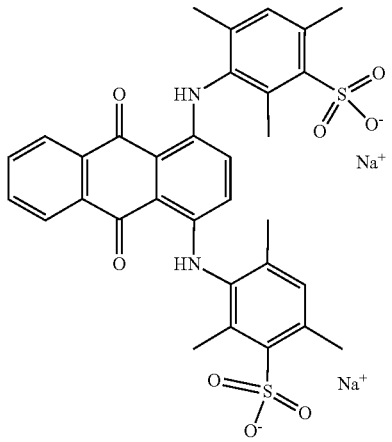

Acid Red 52 has the chemical structure:

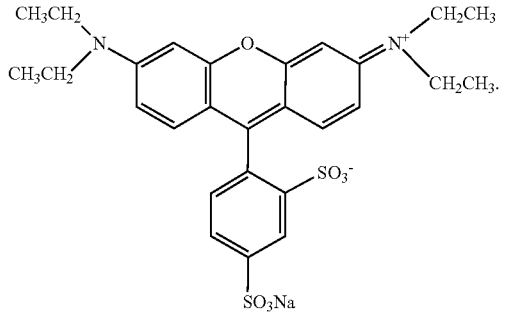

Acid Violet 48 has the chemical structure:

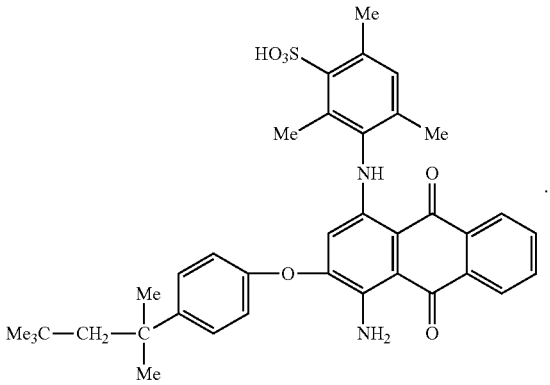

When the colorant(s) are selected from the group consisting of Acid Blue 80, Acid Red 52, and Acid Violet 48, the liquid composition, optionally, does not contain a colorant stabilizer. Surprisingly, it has been found that Acid Blue 80, Acid Red 52, and Acid Violet 48, do not display significant discoloration over time, and thus, can be used without (e.g., in the absence of) a colorant stabilizer.

In some embodiments, the liquid composition comprises by weight about 0.00001% of a colorant. In some embodiments, the liquid composition comprises by weight about 0.0001%, about 0.001%, about 0.01%, about 0.05%, or about 0.08% of a colorant.

Colorant Stabilizer(s)

In some embodiments, the liquid composition can optionally contain a colorant stabilizer. In some embodiments, the colorant stabilizer can be citric acid.

In some embodiments, the liquid composition comprises by weight about 0.01% to about 5.0% of a colorant stabilizer. In some embodiments, the liquid composition comprises by weight about 0.1%, about 1%, about 2%, about 3%, or about 4% of a colorant stabilizer.

Free Fragrance(s) or Perfume(s)

The liquid compositions of the invention may optionally include one or more perfumes or fragrances. As used herein, the term "perfume" is used in its ordinary sense to refer to and include any fragrant substance or mixture of substances including natural (obtained by extraction of flowers, herbs, leaves, roots, barks, wood, blossoms or plants), artificial (mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes) such as from 0 wt % to 80 wt %, usually from 1 wt % to 70 wt %, the essential oils themselves being volatile odoriferous compounds and also serving to dissolve the other components of the perfume. Suitable perfume ingredients include those disclosed in "Perfume and Flavour Chemicals (Aroma Chemicals)", published by Steffen Arctander (1969), which is incorporated herein by reference. Perfumes can be present from about 0.1 wt % to about 10 wt %, and preferably from about 0.5 wt % to about 5 wt % of the composition.

External Structurants

In some embodiments, the liquid composition is substantially free of an external structurant. An external structurant is a material that has a primary function of providing rheological alteration, typically by increasing viscosity of a fluid, such as a liquid or gel or paste. External structurants include microfibrillated celluloses, non-polymeric hydroxyl-containing materials, hydroxyl-containing fatty acids, fatty ester and fatty waxes, such as castor oil, hydrogenated castor oil, and castor oil derivatives. External structurants also include naturally derived and/or synthetic polymeric structurants such as polycarboxylates, polyacrylates, hydrophobically modified ethoxylated urethanes, alkali soluble emulsions, hydrophobically modified alkali soluble emulsions, hydrophobically modified non-ionic polyols, crosslinked polyvinylpyrrolidone, polysaccharide, and polysaccharide derivatives. Polysaccharides derivatives typically used as structurants include polymeric gum materials such as pectin, alginate, arabinogalactan (gum Arabic), carrageenan, gellan gum, xanthan gum, and guar gum. Other external structurants include structuring clays, amidogellants and fatty esters such as isopropyl myristate, isopropyl palmitate, and isopropyl isostearate.

In some embodiments, the liquid composition is substantially free of hydrogenated castor oil. In some embodiments, the liquid composition is substantially free of crystalline external structurants such as non-polymeric hydroxyl-containing materials, microfibrillated celluloses and non-crystalline external structurants such as polymeric structurants selected from the group consisting of polyacrylates, polysaccharides, polysaccharide derivatives, and mixtures thereof.

Weighting Oils

In some embodiments, the liquid composition is substantially free of a weighting oil. A weighting oil can increase the density of an encapsulated fragrance to match the density of the liquid composition. When the encapsulated fragrance has a lower density than the liquid composition it will separate to the top of the container without the presence of a weighting oil. In some embodiments, the weighting oil is selected from the group consisting of brominated esters of long chain fatty acids, brominated fatty alcohols, brominated ketones, brominated amides, brominated nitriles, brominated sulfonated fats, brominated hydrocarbons, brominated liquid polyol polyesters, glycerol ester of wood rosin (ester gum rosin), sucrose acetate isobutyrate (SAIB), gum damar, colophony, gum elemi, and mixtures thereof.

Other Optional Ingredients

The liquid compositions may also contain one or more optional ingredients conventionally included in detergent compositions such as a pH buffering agent, a perfume carrier, a fluorescer, a hydrotrope, an antifoaming agent, an antiredeposition agent, a polyelectrolyte, an optical brightening agent, a pearlescer, an anti-shrinking agent, an anti-wrinkle agent, an anti-spotting agent, a germicide, a fungicide, an anti-corrosion agent, a drape imparting agent, an anti-static agent, an ironing aids crystal growth inhibitor, an anti-oxidant, an anti-reducing agent, a chelating agent, a dispersing agent, a defoamer, a color component, a fragrance component, a bleaching catalyst, a bleaching agent, a bleach activator, a whitening agent, a brightening agent, an anti-corrosion agent, a deodorizing agent, a color/texture rejuvenating agent, a soil releasing polymer, a preservative, a bittering agent, and a mixture thereof. Examples and sources of suitable such components are well-known in the art and/or are described herein. For example, a preferred soil releasing polymer is polyethylene imine ethoxylated, sold under tradename SOKALAN HP 20 (BASF). A preferred bittering agent is denatonium benzoate, sold under the tradename BITREX (Johnson Matthey).

Methods of Making

In some embodiments, the present invention provides a method of making a liquid composition, comprising:

(a) admixing at least one surfactant, at least one low density organic solvent having a density less than 1.0 g/mL, and at least one high density organic solvent having a density greater than 1.0 g/mL; and (b) adding at least one encapsulated fragrance.

In some embodiments, the at least one surfactant, at least one low density organic solvent, and at least one high density organic solvent are added in any order.

Some embodiments further comprise adding the liquid composition to a water soluble pouch and sealing the pouch to form a unit dose product.

Viscosity of the Liquid Compositions

In some embodiments, the viscosity of the liquid compositions described herein can be measured. In some embodiments, the viscosity of the liquid compositions can be measured using a viscometer.

In some embodiments, the liquid compositions have a viscosity from about 10 mPa·s to about 500 mPa·s measured at a shear rate of 20/s. In some embodiments, the liquid compositions have a viscosity from about 10 mPa·s to about 500 mPa·s, about 10 mPa·s to about 250 mPa·s, about 10 mPa·s to about 100 mPa·s, about 10 mPa·s to about 50 mPa·s, about 50 mPa·s to about 500 mPa·s, about 50 mPa·s to about 250 mPa·s, about 50 mPa·s to about 100 mPa·s, about 100 mPa·s to about 500 mPa·s, about 100 mPa·s to about 250 mPa·s, or about 250 mPa·s to about 500 mPa·s measured at a shear rate of 20/s. In some embodiments, the liquid compositions have a viscosity from about 10 mPa·s to about 250 mPa·s measured at a shear rate of 20/s.

Method of Measuring Creaming and Sedimentation of the Liquid Compositions

In some embodiments, the creaming and sedimentation of the liquid compositions described herein can be measured. In some embodiments, particle and droplet velocity distributions for creaming and sedimentation can be measured optically using an analytical centrifuge. Using an analytical centrifuge, the extinction (space- and time-resolved) of the transmitted light across the entire length of a sample can be measured. An analytical centrifuge also allows for the stability and the shelf-life of the liquid compositions to be calculated. In some embodiments, the analytical centrifuge is a LUMISIZER (LUM GmbH, Germany).

The analytical centrifuge measures the gravitational separation of the liquid composition. The analytical centrifuge calculates a separation index value for the liquid composition between 0 and 1.0 with 1.0 being 100% separated.

Improved Properties of the Compositions

In some embodiments, the liquid composition described herein have improved stability against gravitational separation. The stability can be improved by making the specific gravity of the liquid phase close to that of the encapsulated fragrance. Since the specific gravity of the encapsulated fragrance is less than that of the detergent, the specific gravity of the detergent must be decreased. The decrease can be achieved by using selective solvents that produce a lower density detergent.

The liquid compositions described herein show increased stability and allow for storage for extended periods of time. In some embodiments, the liquid compositions can be stably stored at room temperature for at least 7 days. In some embodiments, the liquid compositions can be stably stored at room temperature for at least 15 days, 1 month, 3 months, 6 months, 12 months, or 3 years. In some embodiments, the liquid compositions can be stably stored at room temperature for at least 18 months. In some embodiments, the compositions described herein can be stably stored at room temperature for between 1 day and 3 years. In some embodiments, the liquid compositions can be stably stored at room temperature for between 18 months and 30 months. In some embodiments, the compositions described herein can be stably stored for between 1 day and 3 years, 1 day and 12 months, 1 day and 6 months, 1 day and 3 months, 1 day and 1 month, 1 day and 15 days, 1 day and 7 days, 7 days and 3 years, 7 days and 12 months, 7 days and 6 months, 7 days and 3 months, 7 days and 1 month, 7 days and 15 days, 15 days and 3 years, between 15 days and 12 months, between 15 days and 6 months, between 15 days and 3 months, between 15 days and 1 month, between 1 month and 3 years, between 1 month and 12 months, between 1 month and 6 months, between 1 month and 3 months, between 3 months and 3 years, between 3 months and 12 months, between 3 months and 6 months, between 6 months and 3 years, between 6 months and 12 months, or between 12 months and 3 years.

Gravitational separation is an industrial method of separating two components, either a suspension, or a dry granular mixture where separating the components with gravity is sufficiently practical.

The compositions described herein also show a minimal amount of gravitational separation after an extended period of time. In some embodiments, the liquid compositions show less than 40% gravitational separation after 7 days at room temperature. In some embodiments, the liquid compositions show less than 50%, less than 40%, less than 30%, less than 20%, or less than 10% gravitational separation after 7 days at room temperature. In some embodiments, the liquid compositions show less than 40% gravitational separation after 1 month at room temperature. In some embodiments, the liquid compositions show less than 60%, less than 50%, less than 40%, less than 30%, less than 20%, or less than 10% gravitational separation after 1 month at room temperature.

Methods of Use

The present invention also provides methods of removing soils from soiled dishware or soiled fabrics. For example, the invention provides a method of removing soils from soiled dishware or soiled fabrics.

Soils that are suitably removed from dishware or fabrics using the compositions and methods of the present invention include, but are not limited to, oil-containing soils, carbohydrate-containing soils, protein-containing soils, tannin-containing soils and particulate soils.

In some embodiments, the liquid composition is a component of a unit dose composition. In some embodiments, the liquid composition is a component of a multi-compartment unit dose composition, such as those disclosed in U.S. Pat. No. 8,865,638 and in U.S. Patent Appl. Publication No. 2019/017001, which are incorporated by reference herein in their entireties.

The present disclosure further provides, a unit dose comprising a multi-compartment container formed from a water-soluble polymer having at least two compartments, comprising:

(a) a first compartment containing a solid composition; and (b) a second compartment containing a liquid composition, wherein the liquid composition is as described herein.

The present disclosure further provides, a unit dose comprising a multi-compartment container formed from a water-soluble polymer having at least two compartments, comprising:

(a) a first compartment containing a solid composition; and (b) a second compartment containing a liquid composition;

wherein the liquid composition comprises:

(i) at least one surfactant;

(ii) at least one encapsulated fragrance; and (iii) a solvent system that comprises at least one high density organic solvent having a density less than 1.0 g/mL and at least one low density organic solvent having a density greater than 1.0 g/mL.

In some embodiments, the liquid composition of the unit dose further comprises about 8% to about 25% water. In some embodiments, the first compartment of the unit dose is separate from and sealed off from the second compartment. In some embodiments, the unit dose further comprises an anti-redeposition agent, wherein the anti-redeposition agent is selected from the group consisting of an acrylic homopolymer and an acrylic/styrene copolymer.

Another embodiment is directed to unit dose forms where the liquid formulation can be stably stored at room temperature for between 1 day and 3 years, or for between 7 days and 1 month.

EXAMPLES

The following examples further illustrate the present invention. The liquid compositions are made by combining the listed material in the listed proportions (wt % unless otherwise specified). Example compositions 1 to 5 exemplify compositions according to the present invention but are not necessarily used to limit or otherwise define the scope of the present invention.

Example 1: Liquid Compositions

Exemplary liquid composition formulations of the present invention were prepared using the materials shown in TABLE 1. The liquid composition formulations contain glycerine:glycol ether in a weight ratio of 0:100 (1), 100:1 (2), 50:50 (3), 25:75 (4), and 75:25 (5). The liquid composition formulations were prepared by combining all materials except for the encapsulated fragrance which was added last. Liquid composition formulations were prepared as shown in TABLE 1.

TABLE 1

Liquid Composition Formulations

| Component | Density (g/mL) | 1 | 2 | 3 | 4 | 5 |
|---|---|---|---|---|---|---|
| $C_{12}$-$C_{15}$ alcohol ethoxylate 7EO | 0.97 | 23.074 | 23.074 | 23.074 | 23.074 | 23.074 |
| Alkyl Ether Sulfate (AES) - 60% concentrated | 1.033 | 26 | 26 | 26 | 26 | 26 |
| Monoethanolamine | 1.01 | 3.15 | 3.15 | 3.15 | 3.15 | 3.15 |
| Linear alkyl benzene sulfonic acid (LAS) | 0.999 | 5 | 5 | 5 | 5 | 5 |
| Coconut oil fatty acid | 0.88 | 10 | 10 | 10 | 10 | 10 |
| Propylene glycol | 1.04 | 9 | 9 | 9 | 9 | 9 |
| Encapsulated Fragrance | | 3 | 3 | 3 | 3 | 3 |
| BITREX | 1.05 | 0.05 | 0.05 | 0.05 | 0.05 | 0.05 |
| Butyl CELLOSOLVE | 0.9 | 0 | 20.726 | 10.363 | 5.1815 | 15.5445 |
| Glycerine | 1.26 | 20.726 | 0 | 10.363 | 15.5445 | 5.1815 |
| Total | | 100.000 | 100.000 | 100.000 | 100.000 | 100.000 |

Example 2: Properties of Liquid Composition Formulations 1.5 mL of liquid from each liquid composition formulation of Example 1 was loaded into a 10 mm polyamide synthetic cell (cell 110-135xx, LUM GmbH, Germany). Each cell was placed into a LUMISIZER (LUM GmbH, Germany) 12-channel instrument and spun at 750 rpm for 150 using a light factor of 1.0. Measurements were taken at room temperature. For the first 300 profiles (measurements)

there was a 10 second time interval between each measurement and then there was a 20 second time interval between each measurement for the remainder of the test. The light transmission values between 109.4 nm and 130.1 nm were determined for the first measurement versus the last measurement (9,000 seconds) using SEPVIEW 6 software (LUM GmbH, Germany). Based on a 90% reference light transmission value (the amount of light that would pass through a 10 mm polyamide synthetic cell filled with water), the software calculated the separation index (between 0 and 1.0—with 1.0 being 100% separated) for each liquid composition sample.

The density of each liquid composition sample was measured using a standard densitometer. Properties of the liquid composition formulations are shown in TABLE 2.

TABLE 2

Properties of the Liquid Composition Formulations

| Formulation | Glycerine:Butyl CELLOSOLVE | Specific Gravity ($g/cm^3$) | Average Separation Index (2.5 hours at 75 g-force), n = 2 | Viscosity (mPa · s) |
|---|---|---|---|---|
| 1 | 100:0 | 1.0677 | 0.4115 | 350 |
| 2 | 0:100 | 0.9967 | 0.115 | 20 |
| 3 | 50:50 | 1.0363 | 0.626 | 80 |
| 4 | 75:25 | 1.0509 | 0.7045 | 185 |
| 5 | 25:75 | 1.0155 | 0.3055 | 50 |

As shown in TABLE 2 and the FIGURE, a liquid composition comprising all glycerine shows less separation than a 75% glycerine to 25% glycol ether liquid composition and a 50% glycerine to 50% glycol ether liquid composition. And, a 25% glycerine to 75% glycol ether liquid composition and a 0% glycerine to 100% glycol ether liquid composition showed the least separation of the five liquid composition samples. Therefore, a liquid composition comprising a ratio (by weight) of 75% to 100% glycol ether: glycerine showed greater stability than liquid compositions comprising a lower ratio of glycol ether:glycerine.

It is to be appreciated that the Detailed Description section, in addition to the Summary and Abstract sections, is intended to be used to interpret the claims. The Summary and Abstract sections may set forth one or more but not all exemplary embodiments of the present invention as contemplated by the inventor, and thus, are not intended to limit the present invention and the appended claims in any way.

The breadth and scope of the present invention should not be limited by any of the above-described exemplary embodiments, but should be defined only in accordance with the following claims and their equivalents.

All publications, patents, and patent applications mentioned in this specification are herein incorporated by reference to the same extent as if each individual publication, patent, or patent application was specifically and individually indicated to be incorporated by reference.

What is claimed is:

1. A unit dose detergent product, comprising:

(a) a container formed from a water-soluble or water-dispersible film material; and (b) a stable liquid composition comprising:

(i) two anionic surfactants and at least one nonionic surfactant;

(ii) at least one encapsulated fragrance; and (iii) a solvent system that comprises at least 75% ethylene glycol monobutyl ether and a high density organic solvent having a density greater than 1.0 g/mL selected from the group consisting of 1,2-propanediol, ethylene glycol, diethylene glycol, polyethylene glycol, glycerine, ethoxylated glycerine, and propoxylated glycerine;

wherein the container entraps the liquid composition, and the liquid composition has a separation index value of less than 0.6 after 2.5 hours.

2. The unit dose detergent product of claim 1, wherein the weight ratio of the high density organic solvent to the ethylene glycol monobutyl ether is from about 25:75 to about 10:90.

3. The unit dose detergent product of claim 1, wherein the high density organic solvent is glycerine.

4. The unit dose detergent product of claim 1, wherein the anionic surfactant is an alkyl ether sulfate or a linear alkyl benzene sulfonate.

5. The unit dose detergent product of claim 1, wherein the nonionic surfactant is an alcohol ethoxylate.

6. The unit dose detergent product of claim 1, wherein the anionic surfactant is an alkyl ether sulfate and a linear alkyl benzene sulfonate and the nonionic surfactant is a $C_{12}$-$C_{15}$ alcohol ethoxylate.

7. The unit dose detergent product of claim 1, wherein the liquid composition has a viscosity from about 10 mPa·s to about 500 mPa·s measured at a shear rate of 20/s.

8. The unit dose detergent product of claim 1, wherein the liquid composition can be stably stored at room temperature for between 1 month and 30 months.

9. The unit dose laundry detergent product of claim 1, comprising about 1% to about 5% by weight of the encapsulated fragrance based on total weight of the (b) stable liquid composition.

10. The unit dose laundry detergent product of claim 1, further comprising about 5% to about 15% by weight coco fatty acid based on total weight of the (b) stable liquid composition.

* * * * *